US005415339A

United States Patent [19]

Howard

[11] Patent Number: 5,415,339

[45] Date of Patent: May 16, 1995

[54] DRINKING CUP WITH OPEN RIBBED SIDEWALL

[76] Inventor: Jeremy C. Howard, 14 Olive St., Providence, R.I. 02906

[21] Appl. No.: 225,834

[22] Filed: Apr. 11, 1994

Related U.S. Application Data

[63] Continuation of Ser. No. 50,677, Apr. 21, 1993, abandoned.

[51] Int. Cl.[6] ..... B65D 3/06

[52] U.S. Cl. ..... 229/403; 220/671; 220/400

[58] Field of Search ..... 229/1.5 B; 220/671

[56] References Cited

U.S. PATENT DOCUMENTS

| | | | |
|---|---|---|---|
| D. 47,721 | 8/1915 | Haley . | |
| D. 81,984 | 9/1930 | Kirkpatrick . | |
| D. 199,319 | 10/1964 | Watts et al. . | |
| D. 248,358 | 7/1978 | Thomas . | |
| D. 262,680 | 1/1982 | Lack et al. | D7/6 |
| D. 262,765 | 1/1982 | Lack et al. | D7/14 |
| D. 296,743 | 7/1988 | Durand | D7/14 |
| D. 306,950 | 4/1990 | Foucher | D7/530 |
| 1,482,015 | 1/1924 | Kielberg | 220/671 |
| 2,617,549 | 11/1952 | Egger | 229/1.5 B |
| 3,007,377 | 11/1961 | Muller | 229/1.5 B |
| 3,194,468 | 7/1965 | Baron | 229/1.5 B |
| 3,288,340 | 11/1966 | Shapiro et al. . | |
| 3,443,715 | 5/1969 | Edwards . | |
| 3,503,310 | 3/1970 | Goetz | 229/1.5 B X |
| 3,755,030 | 8/1973 | Doman et al. | 156/73 |
| 3,908,523 | 9/1975 | Shikaya | 229/1.5 B X |
| 4,049,187 | 9/1977 | Florian | 229/1.5 B |
| 4,261,501 | 4/1981 | Watkins et al. | 229/1.5 B |
| 4,284,226 | 8/1981 | Herbst | 229/1.5 B |
| 4,832,212 | 5/1989 | Askinazi | 215/10 |
| 4,836,400 | 6/1989 | Chaffey et al. | 229/1.5 B X |
| 4,867,374 | 9/1989 | Murray et al. | 229/10 |

FOREIGN PATENT DOCUMENTS

| | | | |
|---|---|---|---|
| 1366310 | 9/1974 | United Kingdom | 229/1.5 B |

*Primary Examiner*—Steven M. Pollard
*Attorney, Agent, or Firm*—Volpe and Koenig

[57] ABSTRACT

A drinking cup having bottom and sidewalls which define a liquid holding cavity. The sidewalls include a plurality of vertical ribs which are formed therein with an open base disposed toward the liquid holding cavity. The ribs are present in sufficient numbers to assure that the surfaces of the ribs are the primary contact point between the user's hand and the cup. The sidewall construction provides both improved insulation and strength characteristics. The cup finds particular use with geriatric users.

2 Claims, 6 Drawing Sheets

DRINKING CUP WITH OPEN RIBBED SIDEWALL

This application is a continuation of application No. 08/050,677, filed Apr. 21, 1993, now abandoned.

FIELD OF THE INVENTION

The present invention is concerned with an improved drinking cup that is especially suitable for use with hot liquids such as coffee or tea. The improved drinking cup of the present invention permits the user to drink hot liquids without discomfort or injury to the user's hand from the heat transmitted from the hot liquid through the cup sidewall. More particularly, the present invention is concerned with an improved cup which is characterized by a series of vertically oriented, generally triangular ribs which form a series of generally triangular liquid holding projections. The ribs are provided in sufficient number so that the user's hand will contact the ribs without coming into full contact with the sidewall of the body of the cup. Most particularly, the present invention provides a hot liquid cup which provides protection against discomfort or injury from the hot liquid within and improved sidewall strength to avoid crushing.

DESCRIPTION OF THE PRIOR ART

Disposable drinking cups of both paper and synthetic resin materials are well known. There are many simple paper or synthetic cups which are acceptable for holding cold or luke warm beverages. However, many of the prior art cups are unacceptable for use with hot drinks, such as coffee or tea, which frequently have temperatures in excess of 165° F.

In the case of paper cups, it is known that the cups will transmit the temperature through the cup sidewall. This temperature transmission generally makes it uncomfortable or painful to hold the cup about the sidewall. Many users will tend to gingerly grasp the cup at the upper or lower extremity in order to avoid direct contact with the hot sidewalls. While this is one solution to the problem of transferred heat, it is generally awkward and may contribute to spillage of the hot liquids. It is also known to provide paper cups with handles as one effort to avoid the problem associated with heat transmission through the sidewalls.

With respect to the synthetic resin cups, it is known to provide cups of a foamed synthetic material which has better insulating characteristics. While these cups may transmit some heat, they generally provide adequate protection for the hands of the user. However, the common synthetic cups, while providing insulation, are generally subject to being easily collapsed if squeezed by the user.

While the prior art cups have found many useful applications, they generally continue to exhibit two major problems. The first problem is associated with the insulating quality of the sidewalls. As the insulating quality of the sidewall is increased, the user's sense of the liquid's temperature is decreased. Accordingly, there is an increased potential for the user to attempt consumption of a beverage that is too hot to drink. Two, the prior art cups generally do not provide sufficient sidewall strength for use by older or geriatric consumers. Many geriatric users experience hand strength problems which lead to an unsure handling of cups. As a result, the geriatric user tends to squeeze the cup with a greater force than that which is necessary to secure the cup. In addition, the geriatric user's hands may have decreased sensitivity to heat. Under these conditions, the geriatric user may not appreciate the temperature of the liquid in a highly insulated cup and may attempt to consume the hot beverage. Alternatively, the geriatric user may not be able to sense the sidewall temperature until there has been some damage or burning of desensitized skin.

In view of the above problems with the prior art cups, it is the purpose of this invention to provide a cup which has increased sidewall strength along with increased temperature sensing and insulating abilities.

SUMMARY OF THE INVENTION

The preferred drinking cup has a bottom wall and an upwardly extending sidewall which are Connected to cooperatively form a liquid holding cavity. In general, the free end of the sidewall will terminate in a bead that forms the usual opening in the cup. The improved sidewall construction is characterized by a plurality of vertically oriented, generally triangular projections which extend from the sidewall of the cup and have an open base that is disposed towards the liquid holding cavity. The sidewalls of the triangular ribs extend away from the liquid holding cavity toward an intersection that is spaced from the main body of the cup. The ribs are provided in sufficient number to permit a user to grip the cup with the principle contact being made with the ribs rather than the body of the cup. The liquid which flows into the ribs provides the user with an initial temperature sensing for the liquid in the cup. In addition, the ribs provide increased sidewall strength which is particularly desired with geriatric users.

DESCRIPTION OF THE PREFERRED EMBODIMENTS

Figure 1:
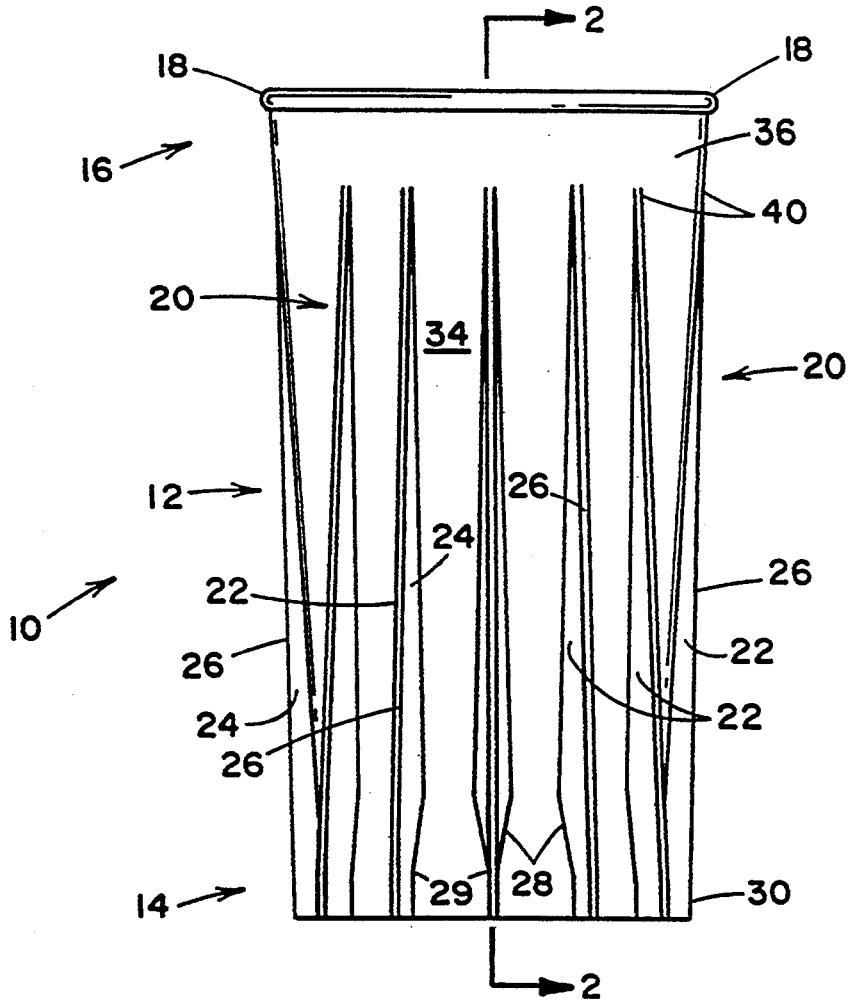
FIG. 1 is a side elevation of a ribbed cup in accordance with the present invention.

The preferred embodiments of the present invention will be described with reference to the drawing figures. Like elements have been identified with the same numeral throughout the drawings.

With reference to FIG. 1, it can be seen that the cup 10 has a sidewall 12 which is joined at the first end 14 to a bottom wall 32 that forms the base of cup 10. The second or open end 16 of the cup 10 terminates in a bead 18 which provides a finished surface for the user's lips. The sidewall 12 includes a plurality of ribs 20. The ribs 20 are separated by sidewall segments 34. Each rib 20 has two sides, 22 and 24, which are joined with the segments 34. Sides 22 and 24 extend outwardly from the segments 34 at opposed angles of approximately 45°. The sides 22 and 24 intersect at 26. The ribs have an open base which is disposed toward the interior of the cup and the sides 22, 24 extend away from the interior of the cup. As a result of this configuration, fluid within the cup will enter into the triangular configuration of the ribs and the user will be able to sense the liquid temperature through contact with the ribs.

As can be seen from FIG. 1 each of the ribs 20 is spaced from the bead 18 by the circumferential ring 36. The circumferential ring 36 is dimensioned to permit the user's lips to contact the bead 18 without necessitating full contact with the ribs 20. The ribs 20 and the circumferential ring 36 meet at the blending points 40. The ribs 20 extend toward the base 14 and increase in depth as they approach base 14 until they reach the angled portion 28. At the end of angled portion 28 the sides 22 and 24 are brought into contact with each other at 29 to form the closed, flat rib portions 30 which continue to be Separated by the sidewall segments 34.

Figure 2:
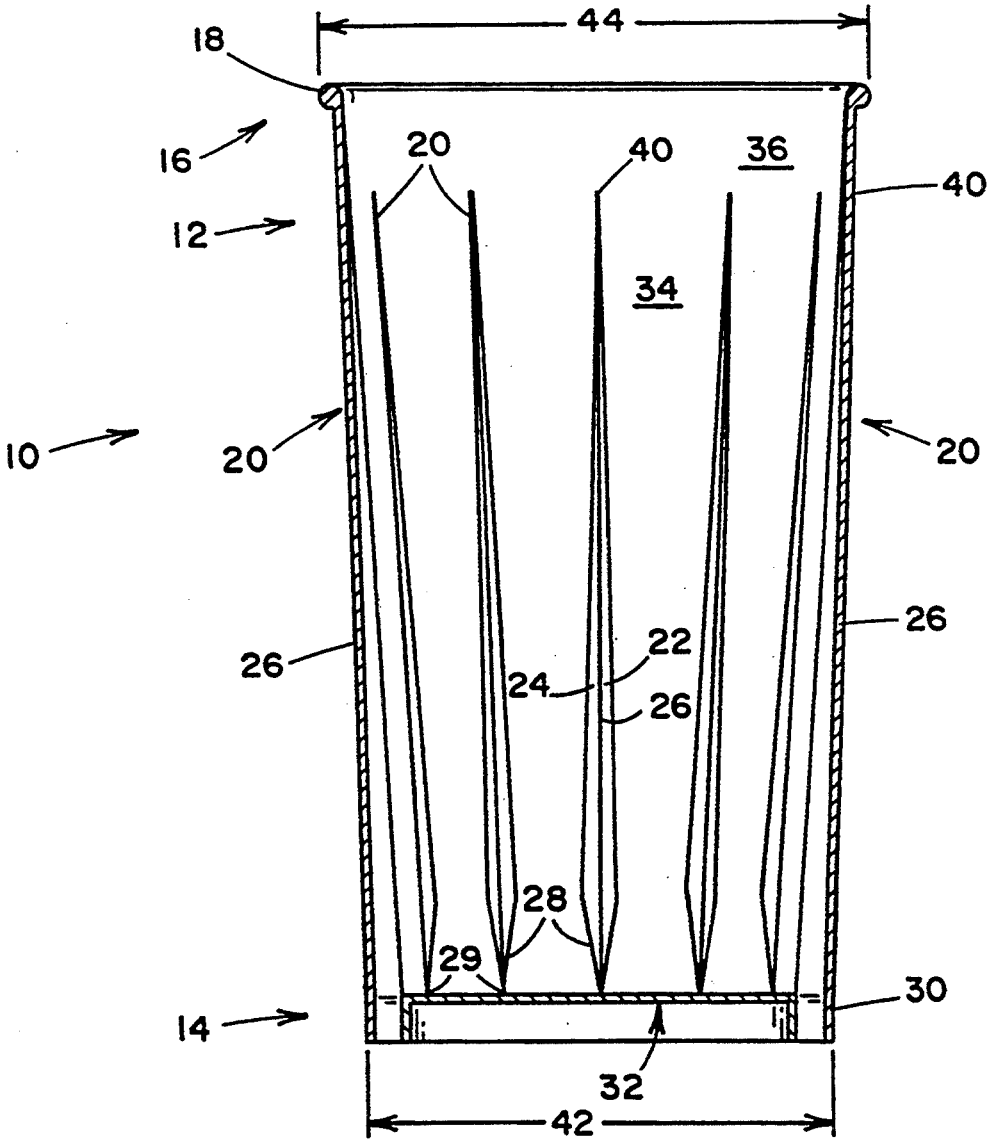
FIG. 2 is a section through the line 2—2 of FIG. 1.
Figure 3:
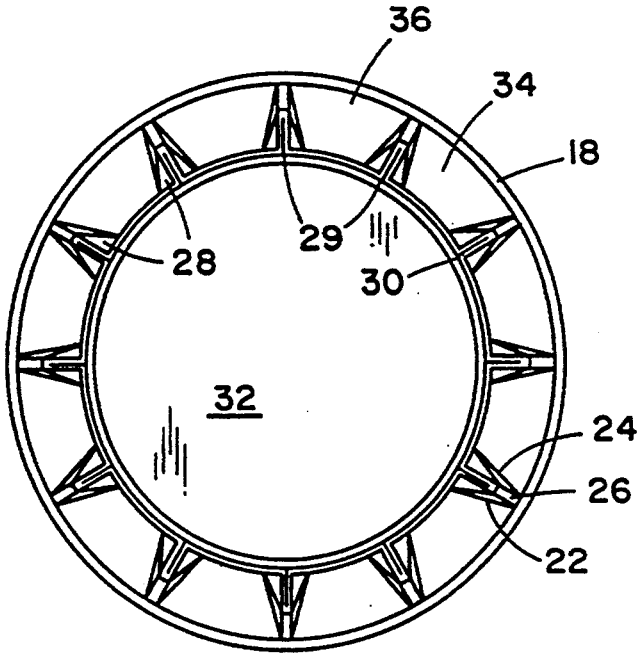
FIG. 3 is a top plan view of the cup shown in FIG. 1.
Figure 6:
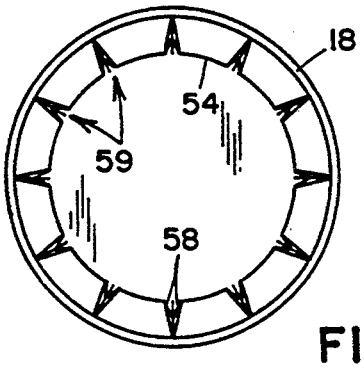
FIG. 6 is a top plan view of the embodiment of FIG. 4.

As can be seen with reference to FIG. 2, the interior portion 30 of ribs 20 and adjoining sidewall segments 34 are joined with the bottom wall 32 to form the closed end of the cup. It can also be seen from FIG. 2 that the cup 10 has a lower diameter 42 which is less than the upper diameter 44 of the cup 10. This allows the cups to be stacked in a nested fashion. As can be seen by reference to FIGS. 2 and 3, the increased rib size or taper from circumferential ring 36 toward the lower angular portions 28 causes the sidewall segments 34 to move inwardly. This configuration combines with the open base of the ribs 20 to facilitate stacking. FIGS. 1, 2, and 3 illustrate a cup with twelve ribs.

As will be apparent from the above description, a hot liquid placed within the cup 10 will enter into the open ribs 20. The user's hand will come into contact with the intersections 26. While the fluid within the ribs 20 will be at about the same temperature as the liquid in the cup, the reduced volume in the ribs and the airflow about the ribs 20 will prevent injury to the user's hands. In addition, the user will be able to exert greater force on the cup due to the reinforcement of the sidewall through the rib configuration. This allows the user to obtain a better grip on the cup and to sense the temperature of the liquid within the cup. As a result, the user will be able to obtain a securer grip on the cup while maintaining a comfortable hand temperature.

With respect to FIGS. 4–7, the alternative embodiment will be described. This embodiment is very similar to the prior embodiment and like numerals indicate like elements. The principle difference between the present embodiment and the prior embodiment is the disposition of the ribs 20. In the prior embodiment, the ribs were formed outwardly so that the sidewall segments 34, at the point adjacent the bottom wall 32, had substantially the same diameter as the bottom wall and the ribs extended outwardly. In this embodiment, the sidewall portions 54 extend inwardly and the ribs 20 are configured so that the interior portion 60 of the ribs 20 and the adjoining sidewall segments 54 have a common circumference. At this point, the diameter of the sidewall is substantially uniform and fits about the bottom wall 32. Accordingly, the ribs do not extend beyond the circumference defined by the sidewall. As in the prior embodiment, the sidewall is a slightly conical, tubular body which is truncated just after its union with bottom wall 32 and is terminated at the other end in the bead 18.

Figure 4:
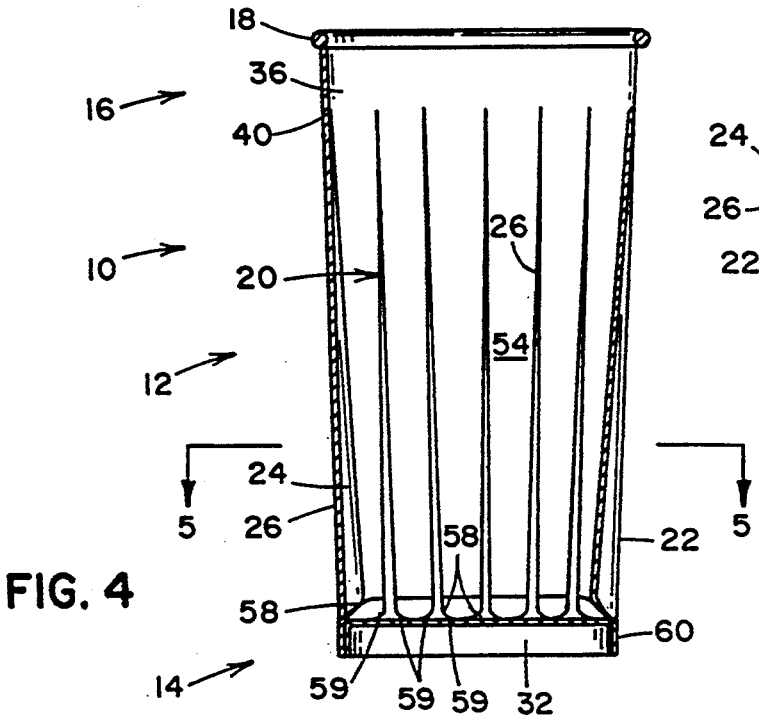
FIG. 4 is a sectional view of an alternative embodiment of the rib configuration.
Figure 5:
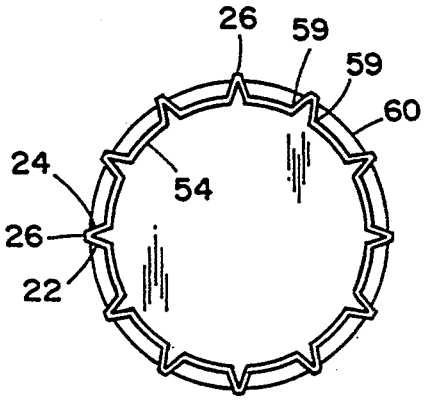
FIG. 5 is a section through the line 5—5 of FIG. 4.
Figure 7:
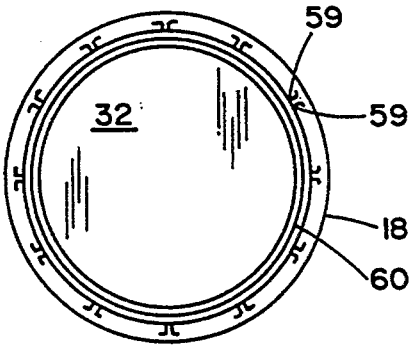
FIG. 7 is a bottom plan view of the embodiment shown in FIG. 4.

With reference to FIG. 4, it can be seen that the angled portion 58 of this second embodiment is disposed inwardly and the ribs 22 and 24 flair away from each other at the union 59 with bottom wall 32.

As can be seen by reference to the drawing figures, the embodiment of FIG. 1 will provide a cup interior which is substantially uniform while the exterior has undergone modifications to provide the rib structure. On the other hand, the exterior of the alternative embodiment, shown in FIG. 4, will be more uniform in shape and the rib configuration will result from the modification of the interior. At present, it is believed that both rib configurations will provide increased strength in the sidewall. However, it is also believed that the configuration of the second embodiment may, because of its interiorly disposed segments 54, provide a better griping surface.

Figure 8:
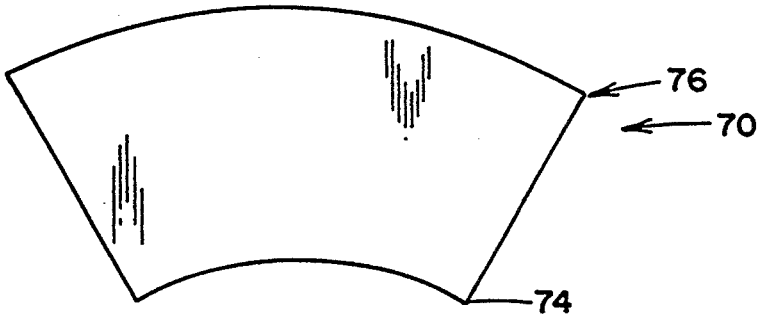
FIG. 8 (PRIOR ART)
FIG. 8 illustrates the shape of a prior art sidewall blank prior to being formed into a cup.
Figure 9:
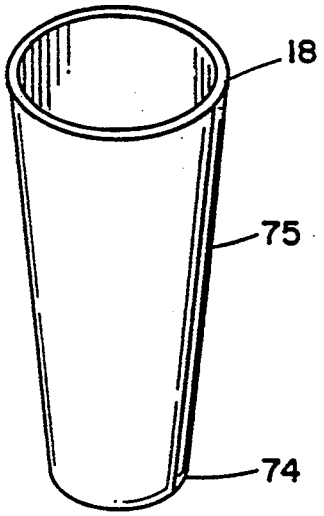
FIG. 9 (PRIOR ART)
FIG. 9 illustrates the cup as formed in the prior art.

With reference to FIG. 8, there is illustrated a prior art sidewall blank 70 for forming a cup that will be approximately 4 ½ inches high with an outer diameter of 2½ inches at the bottom and an outer diameter of 3½ inches at the top. See FIG. 9. As shown in FIG. 8, the prior art blank has an arcuate bottom 74, an arcuate top 76 and joining sides which taper from 76 to 74. The arc length 76 in the prior art blank of this example is approximately 10¼ inches. The effective length is approximately 10 inches since approximately ¼ of an inch is used to form the seam 75 as shown in FIG. 9. In such prior art cups, the blank is formed as shown in FIG. 8 and then is rolled about a mandrel and sealed at 75 to form a sidewall of the type shown in FIG. 9.

Figure 10:
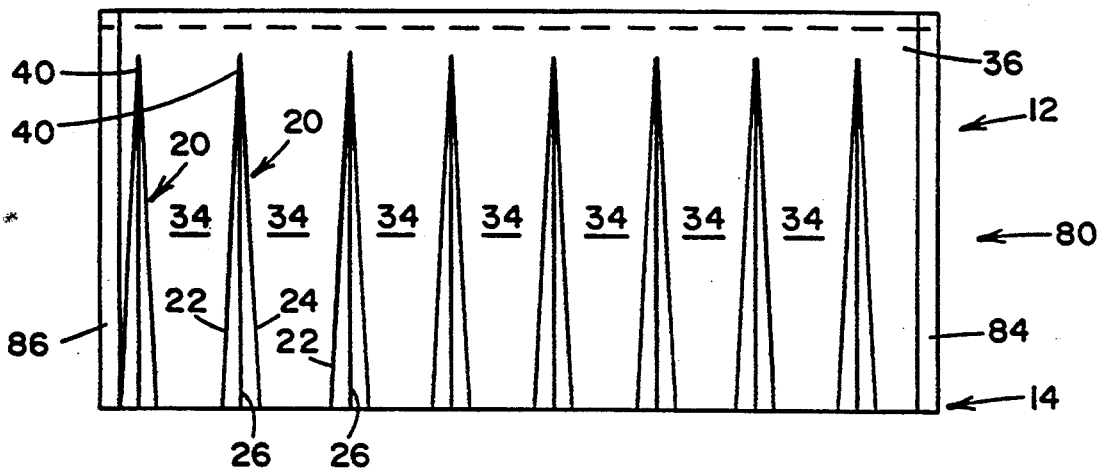
FIG. 10 illustrates a sidewall blank for a cup according to the present invention with the fold lines for the eight ribs illustrated thereon.
Figure 11:
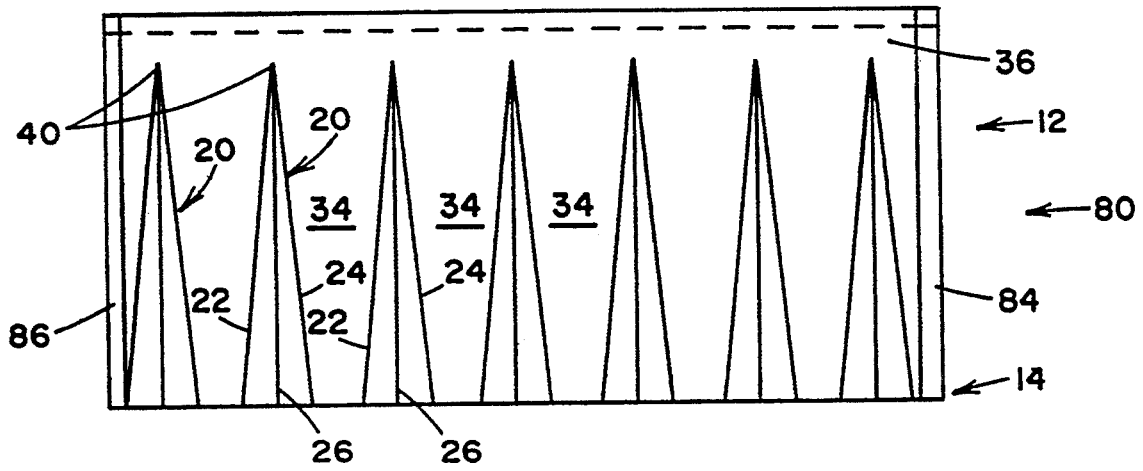
FIG. 11 illustrates a sidewall blank for a cup according to the present invention with the fold lines for the seven ribs illustrated thereon.

In the present invention, the blank for forming the sidewall is generally rectangular, as shown in FIGS. 10 and 11. With reference to FIG. 10, the blank 80 is approximately 10¼ inches long. As with the prior art, the vertical boarders 84 and 86 will be overlapped and sealed to close the sidewall. Spaced between the vertical boarders 84 and 86 is an area of approximately 10 inches. Within this 10 inches, there are a number of ribs 20 which are formed in the blank. As illustrated in FIG. 10, there are eight ribs formed between the vertical boarders 84 and 86. As illustrated in FIG. 11, there are seven ribs formed between vertical boarders 84 and 86. Each of the ribs 20 will have opposed, identical sides 22 and 24 that are joined at intersection 26. As can be seen from FIG. 10, the ribs will appear as elongated pyramids. As discussed earlier, the ribs are separated by sidewall segments 34.

Figure 12:
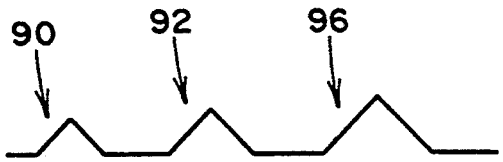
FIG. 12 illustrates three different rib configurations which are usable with the present invention.

Referring now to FIGS. 10, 11, and 12, some examples of rib and segment sizes will be described. If the rib 90 is an equilateral triangle of approximately 3/16 of an inch, the blank 80 will accommodate twelve ribs spaced by ½ inch segments. The rib size is measured adjacent to the first end or base 14 at the point where the sidewall meets the bottom wall 32. For the embodiment illustrated by rib 92 of FIG. 12, there will be eight ribs of ¼ inch which are spaced by segments of ¾ of an inch. For the rib 96, there will be eight ribs of 5/16 of an inch spaced by segments of 11/16 of an inch. From these examples, it can be seen that a ten inch blank may be divided into different combinations of ribs and segments. At present, it is preferred that a ten inch blank have at least eight ribs. More preferably, a ten inch blank will have eight ¼ inch ribs spaced by ¾ inch segments. It has been found that this combination will provide a sufficient spacing between the intersections 26 and the segments 34 to prevent an adult user from coming into close contact with the cup body. The use of an uneven number of ribs, as illustrated in FIG. 11, will assure that there are not two ribs which are directly opposite each other.

From the above description, it will be understood that the number and size of ribs will change in accordance with the cup size. For the example of a ten inch blank as provided above, the resulting cup will be a 20 ounce cup. It will also be seen from the above description that the present cup can be stacked or nested as is commonly desired in the art. In addition, the inclusion of circumferential ring 36 and the bead 18 permits the use of a dispenser with the present cup.

I claim:

1. A paper drinking cup of the type having a bottom wall and an elongate, open ended sidewall which defines an interior volume, the bottom wall is connected to a first end of the sidewall to define a liquid holding cavity, the improvement is characterized by:

a sidewall formed from a blank having inwardly curved ends which are joined at a vertical seam;

a plurality of ribs formed on the sidewall which are separated by sidewall segments, the seam is located in one sidewall segment, each rib extends along the sidewall and has an open base disposed toward the liquid holding cavity so that liquid within the cavity enters into each rib, the ribs are limited in number and arranged in a spaced relationship to each other to assure that the primary contact points between a user's hand and the cup are the ribs.

2. The cup of claim 1 wherein the ribs are asymmetrically located. located.

* * * * *